US009789382B2

(12) United States Patent
Aussprung

(10) Patent No.: US 9,789,382 B2
(45) Date of Patent: Oct. 17, 2017

(54) HYBRID SKATE

(71) Applicant: Brent E. Aussprung, Whitefish Bay, WI (US)

(72) Inventor: Brent E. Aussprung, Whitefish Bay, WI (US)

( * ) Notice: Subject to any disclaimer, the term of this patent is extended or adjusted under 35 U.S.C. 154(b) by 0 days.

(21) Appl. No.: 15/304,093

(22) PCT Filed: Apr. 15, 2015

(86) PCT No.: PCT/US2015/025868
§ 371 (c)(1),
(2) Date: Oct. 14, 2016

(87) PCT Pub. No.: WO2015/160885
PCT Pub. Date: Oct. 22, 2015

(65) Prior Publication Data

US 2017/0028290 A1 Feb. 2, 2017

Related U.S. Application Data

(60) Provisional application No. 61/980,426, filed on Apr. 16, 2014.

(51) Int. Cl.
*A63C 1/28* (2006.01)

(52) U.S. Cl.
CPC ..... *A63C 1/28* (2013.01)

(58) Field of Classification Search
None
See application file for complete search history.

(56) References Cited

U.S. PATENT DOCUMENTS

| | | | | |
|---|---|---|---|---|
| 6,193,243 | B1 * | 2/2001 | Johannes Meester | A63C 1/28 280/11.12 |
| 6,736,412 | B1 * | 5/2004 | Krah | A63C 1/28 280/11.14 |
| 6,883,811 | B2 * | 4/2005 | Tlucko | A63C 1/28 280/11.224 |
| 6,971,652 | B2 * | 12/2005 | Bobbert | A63C 1/28 280/11.12 |
| 7,270,343 | B2 * | 9/2007 | Riepler | A43B 5/0417 280/11.224 |
| 7,367,574 | B2 * | 5/2008 | Leitner | B60R 3/02 280/163 |

(Continued)

FOREIGN PATENT DOCUMENTS

| | | | |
|---|---|---|---|
| NL | 1019089 | * | 4/2003 |
| NL | 1019089 C2 | | 4/2003 |
| WO | 2011/025376 A2 | | 3/2011 |

OTHER PUBLICATIONS

International Search Report and Written Opinion dated Jul. 20, 2015.

*Primary Examiner* — John Walters
*Assistant Examiner* — Hilary L Johns

(57) ABSTRACT

A skate including a bridge member, and a blade assembly pivotably coupled to the bridge member about a transverse axis. The blade assembly is capable of pivoting relative to the bridge member. The skate is operable in a first mode of operation during a predetermined interval, and a second mode of operation after the predetermined interval. The skate is configured to automatically transition from the first mode of operation to the second mode of operation.

18 Claims, 14 Drawing Sheets

(56) References Cited

U.S. PATENT DOCUMENTS 7,380,807 B2 * 6/2008 Leitner ..... B60R 3/02 280/163
7,383,908 B2 * 6/2008 Tuli ..... A43B 3/0005 180/181
7,398,985 B2 * 7/2008 Leitner ..... B60R 3/02 280/163
7,487,986 B2 * 2/2009 Leitner ..... B60R 3/02 280/163
7,584,975 B2 * 9/2009 Leitner ..... B60R 3/02 280/163
7,629,141 B2 * 12/2009 Bruce ..... C07K 14/21 435/32
7,637,519 B2 * 12/2009 Leitner ..... B60R 3/02 280/163
7,740,261 B2 * 6/2010 Leitner ..... B60R 3/02 280/163
7,871,086 B2 * 1/2011 Zampieri ..... A63C 17/0046 280/11.221
7,896,363 B2 * 3/2011 Lovejoy ..... A43B 5/1641 280/11.12
8,292,307 B2 * 10/2012 Zampieri ..... A63C 17/06 280/11.19
8,348,299 B2 * 1/2013 Ekberg ..... A63C 5/02 280/11.27
8,746,707 B2 * 6/2014 Zampieri ..... A63C 1/02 280/11.12
8,801,025 B2 * 8/2014 Mars ..... A63C 1/22 280/607
8,827,294 B1 * 9/2014 Leitner ..... B60R 3/02 280/166
8,857,823 B2 * 10/2014 Mars ..... A63C 1/303 280/11.15
8,960,711 B2 * 2/2015 Svensson ..... A43B 5/0421 280/636
9,101,816 B2 * 8/2015 Mars ..... A63C 17/0046
9,265,300 B2 * 2/2016 Svensson ..... A43B 5/0486
9,326,563 B2 * 5/2016 Svensson ..... A43B 5/0411
9,339,718 B2 * 5/2016 Cornillon ..... A63B 25/10
9,346,405 B2 * 5/2016 Leitner ..... B60R 3/02
2010/0264638 A1 * 10/2010 Meijer ..... A63C 1/28 280/841

* cited by examiner

HYBRID SKATE

CROSS-REFERENCE TO RELATED APPLICATIONS

This application claims priority to U.S. Provisional Patent Application No. 61/980,426, filed Apr. 16, 2014, the entire contents of which are incorporated by reference herein.

FIELD OF THE INVENTION

The present invention relates to a skate, and more particularly to a racing ice-skate which is commonly used in speed skating.

BACKGROUND

A skate typically includes, among other things, an ice blade coupled to a shoe (e.g., a boot). Generally speaking, a skate such as a speed skate falls into one of two categories: a conventional ice-skate (i.e., fixed ice-skate) or a clap ice-skate. A fixed ice-skate generally is configured with the ice blade directly secured to the to the boot such that movement of the ice blade relative to the boot is prohibited. Conversely, a clap ice-skate is generally configured with the ice blade pivotably coupled to the boot such that rotation of the ice blade relative to the boot is permitted. The fixed ice-skate and clap ice-skate each contain characteristics that are both advantageous and disadvantageous.

Since its introduction, the clap ice-skate has generally demonstrated a long-term performance advantage over the fixed ice-skate in speed skating, which has been most evident by the dramatic decrease in speed skating racing times. Generally, the clap ice-skate provides an ice skater (e.g., an operator) with the ability of maintaining contact between the ice blade and the ice while the ice skater performs a plantar flexion push-off movement relative to the ground as characterized, for example, in U.S. Pat. No. 6,193,243. Contrary to the fixed ice-skate, the clap ice-skate enables the ice skater to transfer force into the ice for a longer duration which, in turn, assists in propelling the ice skater to a higher velocity. However, the clap ice-skate has demonstrated disadvantages during acceleration periods (e.g., the start of a race, etc.). In particular, when the heel of the boot pivots away from the rear of the ice-blade (e.g., from the plantar flexion movement relative to the ground), the ice skater is balancing over a single point (e.g., a hinge mechanism). If the push-off force is not transferred through the single point and perpendicular to the ice-blade, the ice-blade slides forward or rearward on the ice. Although this can happen at any portion of the race, the sliding of the blade is dramatized during acceleration periods due to the greater magnitude of force transfer from the ice blade to the ice. Sliding of the ice-blade, either forward or rearward, with respect the ice skater often causes a slip or fall for the ice skater.

As previously mentioned, the fixed ice-skate prohibits rotation of the blade relative to the boot, and therefore as the ice skater performs the plantar flexion movement relative to the ground, a tip of the ice blade digs into the ice providing traction for the skater. The increased traction assists in the stability of the ice skater, and thus the fixed ice-skate is advantageous during acceleration periods compared to the clap ice-skate.

A recent study was carried out, in which a group of speed skaters performed a series of starts that were timed from a standing still start. The study uncovered that, on average, the fixed ice-skate provided a time savings benefit of 0.1325 second over the clap ice-skate within a five-meter start. This amount of time saving benefit (i.e., 0.1325 second) is often the finishing time difference between multiple speed skaters during a speed skating sprint race (e.g., a 500-meter race). In fact, at the XXII Winter Olympic Games in Russia, a time of 0.1325 second differentiated the finish time of 8 speed skaters in the final 500-meter race (i.e., $7^{th}$ place to $14^{th}$ place).

SUMMARY

In one independent aspect, a skate includes a bridge member, and a blade assembly pivotably coupled to the bridge member about a transverse axis. The blade assembly is capable of pivoting relative to the bridge member. The skate is operable in a first mode of operation during a predetermined interval, and a second mode of operation after the predetermined interval. The skate is configured to automatically transition from the first mode of operation to the second mode of operation.

In another independent aspect, a method of operating a skate includes providing the skate with a mechanical mechanism. The mechanical mechanism is configured to facilitate the automatic transition of the skate during conventional skating technique from a first mode of operation to a second mode of operation. The second mode of operation is different from the first mode of operation.

In yet another independent aspect, a mechanical mechanism of a skate includes a locking mechanism and an indexing mechanism. The lock mechanism is configured to lock a blade assembly of the skate relative to a bridge member of the skate. The index mechanism is configured to facilitate the automatic unlocking of the lock mechanism responsive to a predetermined interval being exceeded through conventional skating technique, where the blade assembly rotates relative to the bridge assembly when the lock mechanism is unlocked.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Furthermore, the components described in detail below can be made of any suitable material including but not limited to polymers, plastics, thermoplastics, elastomeric plastics, metals, or combination thereof.

DETAILED DESCRIPTION

The embodiments as illustrated and described hereinafter generally relate to an ice-skate, of which can be configured in a first mode of operation during a predetermined interval and a second mode of operation after the predetermined interval that is different than the first mode of operation.

Figure 1:
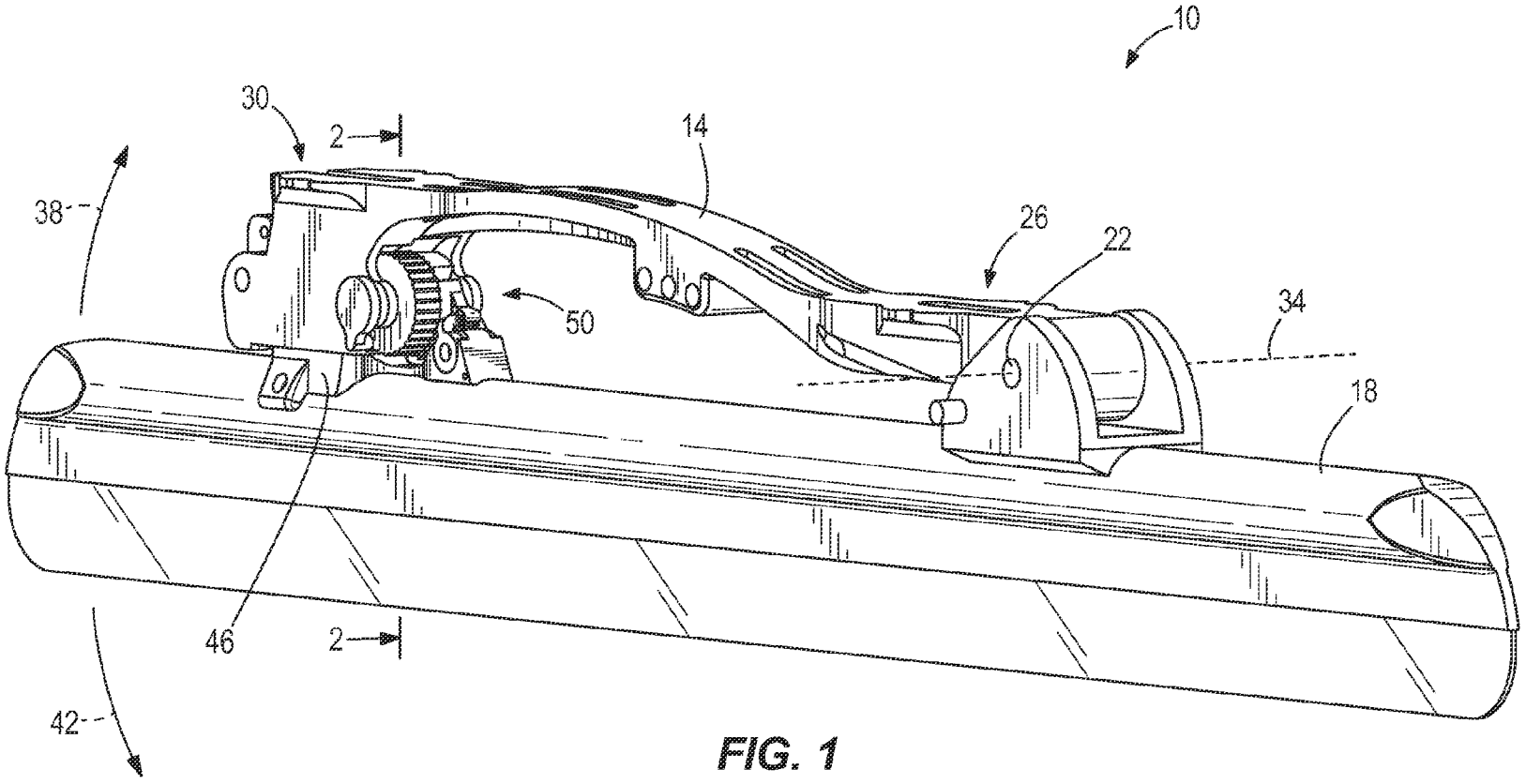
FIG. 1 is a perspective view of an ice-skate in accordance with an embodiment of the invention.
Figure 2:
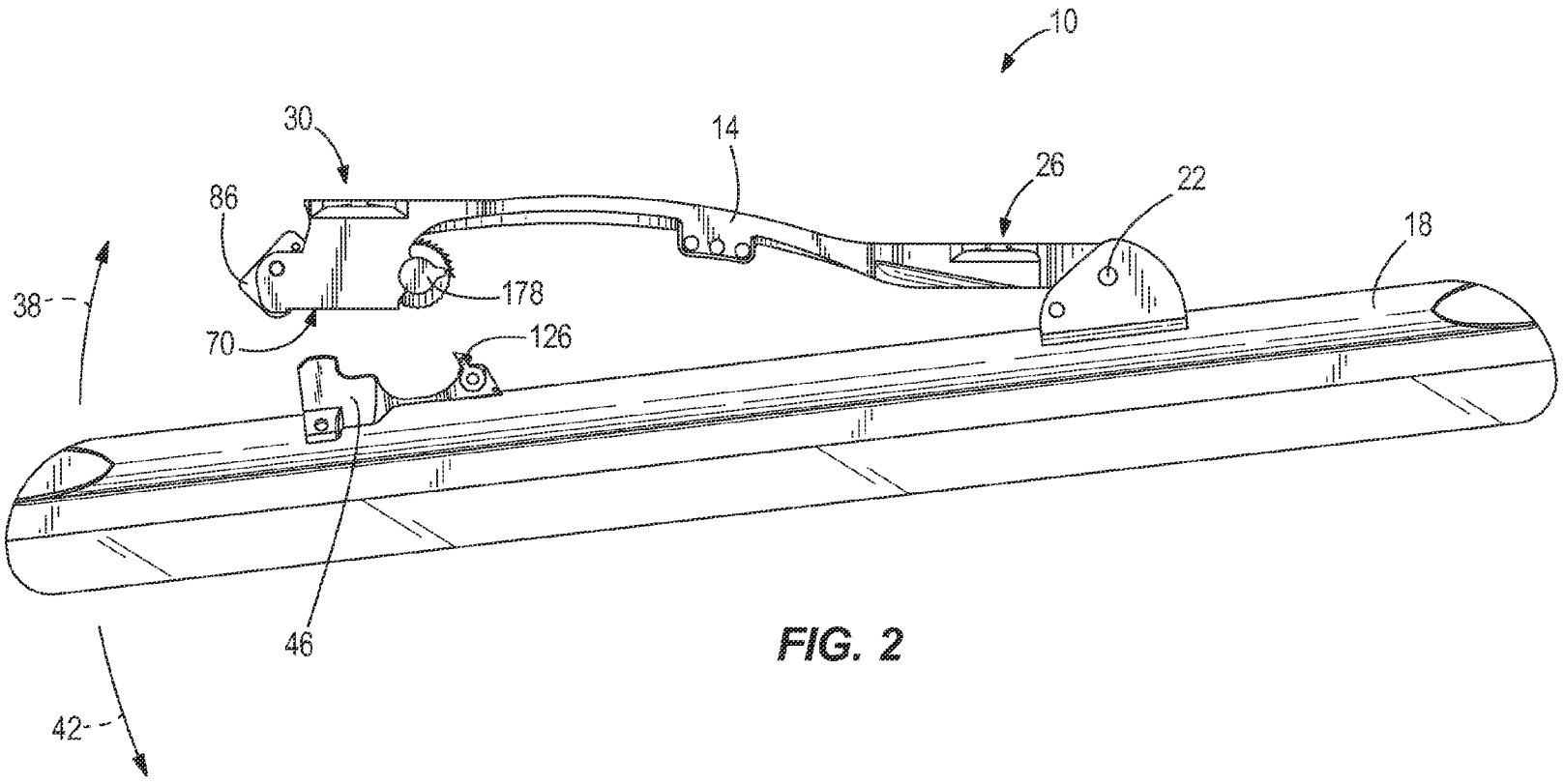
FIG. 2 is a side view of the ice skate of FIG. 1.

FIGS. 1 and 2 illustrate the ice-skate, shown as hybrid skate 10. The hybrid skate 10, as shown in FIG. 1, is configured in the first mode of operation, whereas the hybrid skate 10, as shown in FIG. 2, is configured in the second mode of operation. The hybrid skate 10 includes a bridge member 14 that supports a boot (not shown), and a blade assembly 18 pivotably coupled to the bridge member 14 through a hinge 22. Each end of the bridge member 14 includes respective mounts (i.e., a front mount 26 and a rear mount 30) to selectively secure the boot to the bridge member 14 through suitable fasteners (e.g., bolts, screws, rivets).

Figure 3:
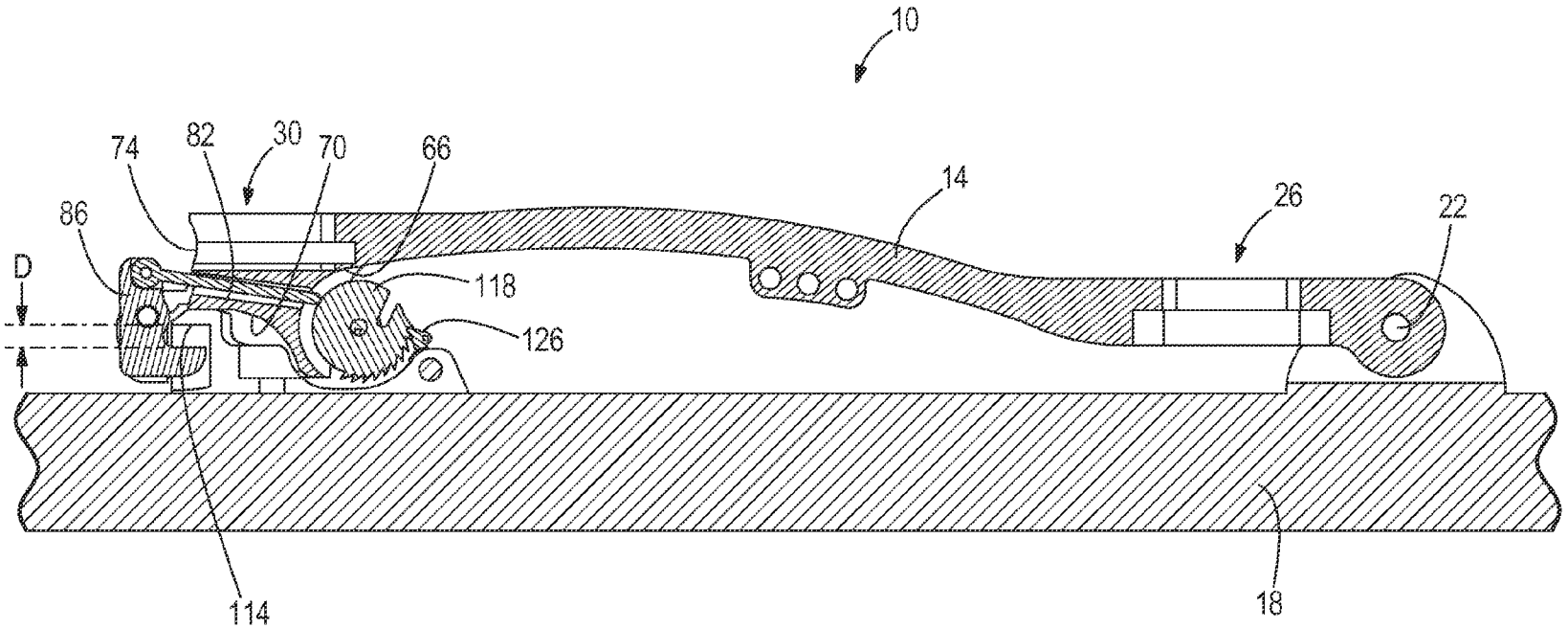
FIG. 3 is a cross-sectional view of a portion of the ice-skate of FIG. 1.

As illustrated in FIG. 1, the hinge 22 is proximate the front of the hybrid skate 10 and defines a transverse axis 34 (i.e., rotational center) about which the blade assembly 18 can pivot either in direction 38 or direction 42 relative to the bridge member 14. The blade assembly 18 is spring biased in direction 38 by a pre-tensioned spring (not shown) that is selectively coupled between the blade assembly 18 and the bridge member 14. To limit rotation in direction 38 through which the blade assembly 18 can pivot, a support 46 abuts the rear mount 30 (FIG. 3). The support 46, which is disposed on the blade assembly 18 proximate the rear of the hybrid skate 10, abuts the rear mount 30 in a default or home position. To pivot the blade assembly 18 in direction 42 against the spring bias (FIG. 2), an ice skater performs a plantar flexion movement relative to the ground (e.g., ice, etc) resulting in the bridge member 14 pivoting away from the blade assembly 18.

With reference to FIGS. 1-4, the hybrid skate 10 further includes a mechanical mechanism 50 at least partially embedded within the rear mount 30 of the bridge member 14. As discussed in further detail below, the mechanical mechanism 50 is capable of automatically transitioning the hybrid skate 10 from the first mode of operation (e.g., a fixed ice-skate, etc.) to a second mode of operation (e.g., a clap ice-skate, etc.). Thus, when a skater performs conventional skating technique (e.g., typical skating movements when a skater performs successive skating strides, etc.), the mechanical mechanism 50 facilitates the automatic transition of the hybrid skate 10 from the first mode of operation to the second mode of operation without any additional assistance from the skater. Specifically, in response to a plantar flexion movement relative to the ground, which is commonly performed during conventional skating technique, the mechanical mechanism 50 advances and facilitates the transition of the hybrid skate 10 between the first mode and the second mode of operation.

Figure 4:
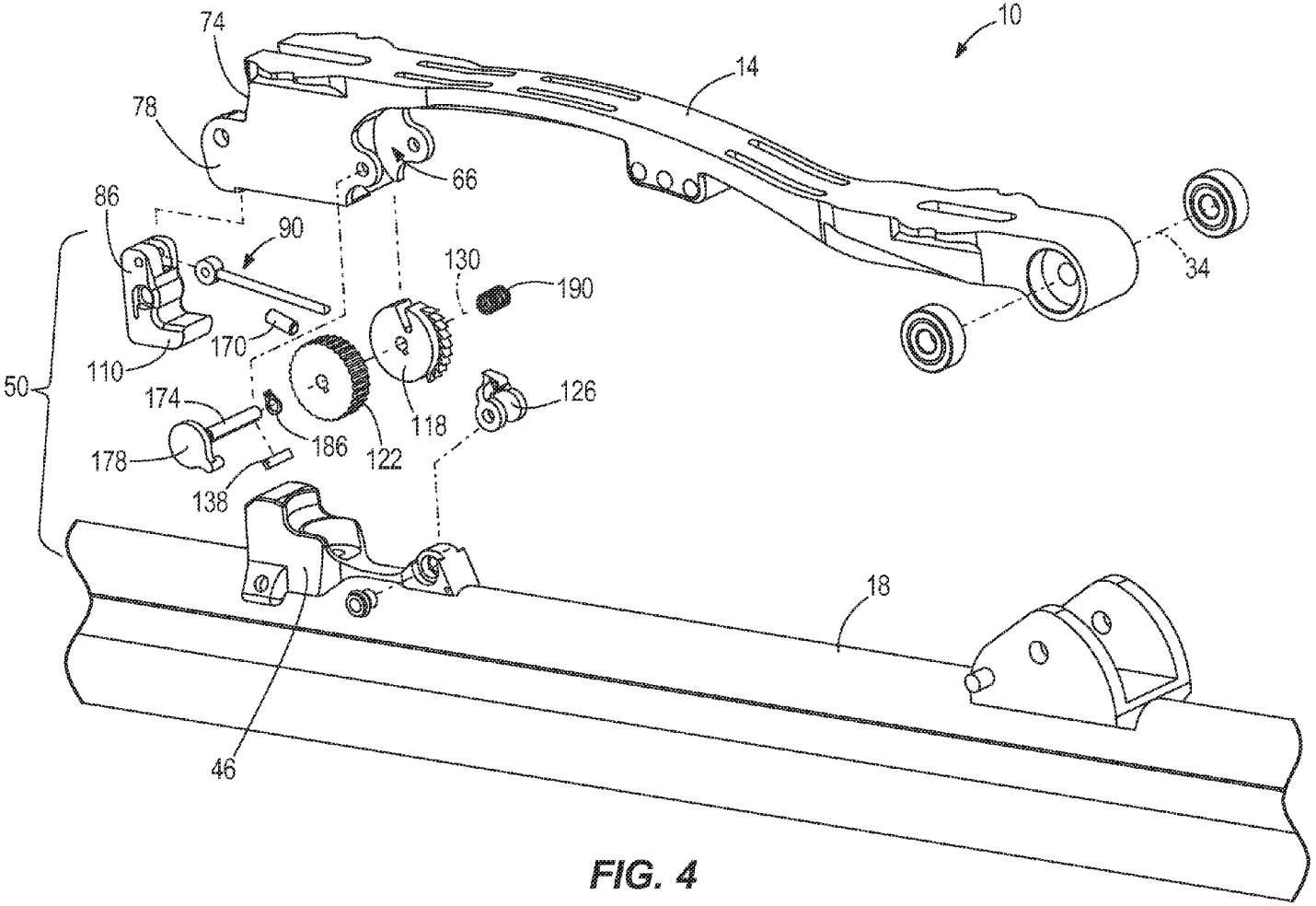
FIG. 4 is an exploded view of a portion of the ice-skate of FIG. 1.

With reference to FIG. 4, the mechanical mechanism 50 includes an index mechanism 54 (FIG. 6), a lock mechanism 58 (FIG. 5), and a userability mechanism 62. During the first mode of operation, the index mechanism 54 and the lock mechanism 58 work in conjunction to limit the rotation of the blade assembly 18 relative to the bridge member 14. The index mechanism 54 defines the predetermined interval that the hybrid skate 10 remains in the first mode of operation before automatically transitioning to the second mode of operation. In the illustrated embodiment of the hybrid skate 10, the index mechanism 54 is configured to ratchet throughout the predetermined interval. The lock mechanism 58 pivotably constrains the blade assembly 18 relative to the bridge member 14. The userability mechanism 62 is configured to facilitate the transition of the hybrid skate 10 from the second mode of operation to the first mode of operation. The userability mechanism 62 is also capable of at least one of setting and adjusting the predetermined interval. The predetermined interval can be defined by a number of parameters including, but certainly not limited to, a number of skating strides a skater performs (e.g., 8 strides, 9 strides, etc.), an elapsed time, and/or a distance skated (e.g., 10-meters, 20-meters, etc.).

In the illustrated embodiment of the hybrid skate 10, the rear mount 30 of the bridge member 14 is configured to accommodate the index mechanism 54, the lock mechanism 58, and the userability mechanism 62 (FIGS. 3 and 4). The rear mount 30 includes a pocket 66 for at least partially housing the index mechanism 54. The rear mount 30 further includes a bottom cavity 70 to receive the support 46, and a backside 74 having a pair of outwardly extending walls 78. Each wall 78 is opposed to each other, such that the lock mechanism 58 is received between the walls 78. Extending between the pocket 66 and the backside 74 of the rear mount 30 is a passage 82 structured to receive a portion of the lock mechanism 58.

Figure 5:
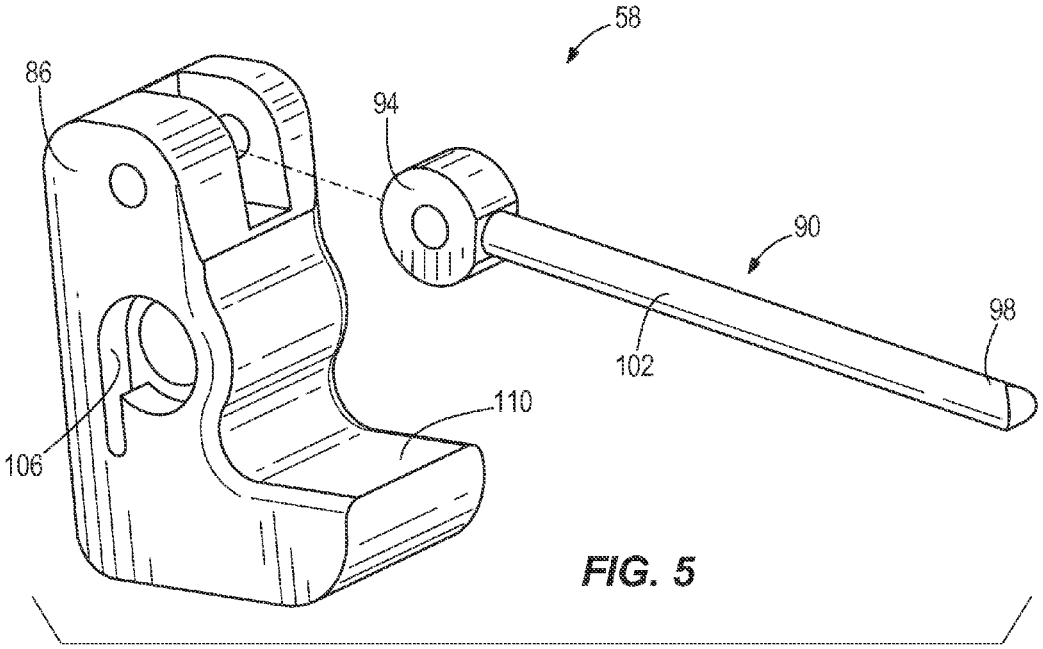
FIG. 5 is a perspective view of a lock mechanism of the ice-skate.
Figure 13:
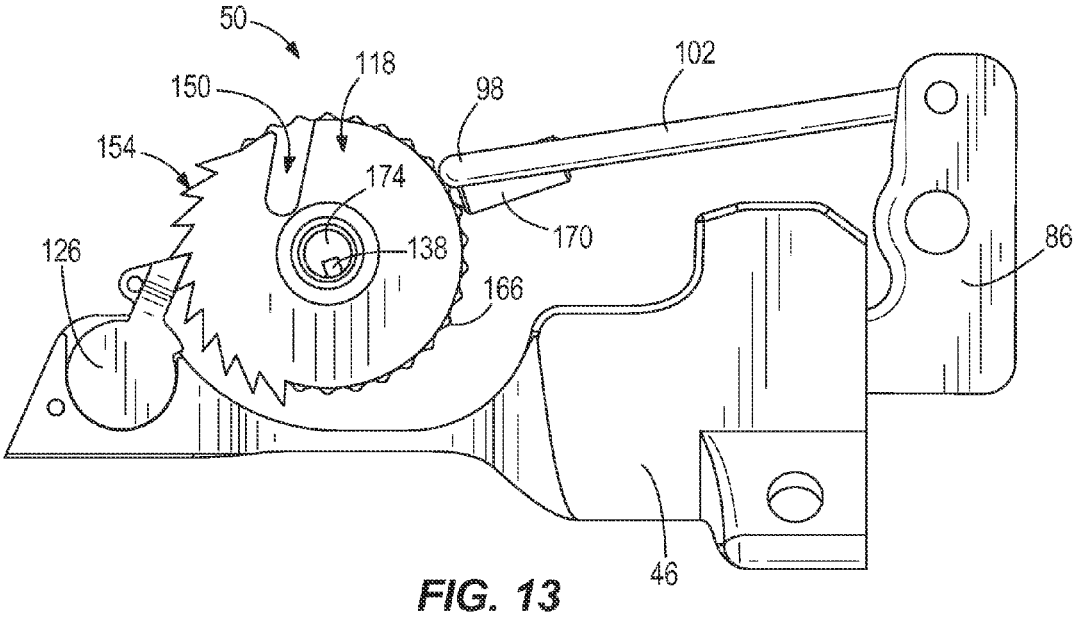
FIG. 13 is another side view of the mechanical mechanism.

With reference to FIGS. 3-5, the lock mechanism 58 is at least partially coupled to at least one of the bridge member and the blade assembly. The lock mechanism 58 includes an L-shaped bracket 86 (e.g., a first lock member), and a piston 90 pivotably coupled to the L-bracket 86 via a joint 94 located at an end of the piston 90 (FIG. 5). Although not shown, a suitable fastener (e.g., a bolt, a screw, a rivet) may facilitate the coupling of the piston 90 to the L-bracket 86 at the joint 94. An opposing end of the piston 90, shown as distal end 98, may have a rounded tip. According to an exemplary embodiment, the rounded tip of the distal end 98 interfaces with the index mechanism 54 (FIG. 13) to facilitate a single point of contact between the distal end 98 and the index mechanism 54 thereby reducing friction. Extending therebetween the distal end 98 and the joint 94 of the piston 90 is a shaft 102 that is slidably received in the passage 82 of the rear mount 30 (FIG. 3).

Figure 16:
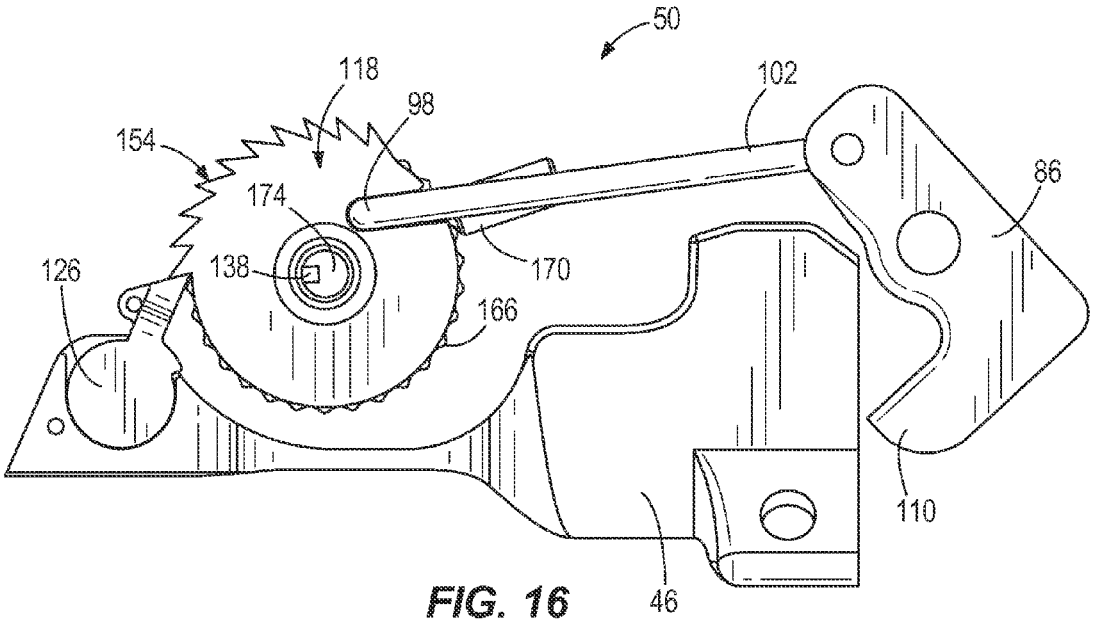
FIG. 16 is yet another side view of the mechanical mechanism.

With reference to FIGS. 2-5, the L-bracket 86 is rotationally coupled between the outwardly extending walls 78 of the rear mount 30 (FIG. 2). This rotational coupling facilitates the bracket 86 to rotate in and out of a cavity to selectively interact with the support 46 (e.g., a second lock member). Generally, the lock mechanism 58 includes the first lock member configured to engage with the second lock member in a locked state (i.e., locked position, locked mode), whereas the first lock member is configured to disengage from the second lock member in an unlocked state (i.e., unlocked position, unlocked mode). When the L-bracket 86 is rotated in the cavity, the L-bracket 86 is configured to selectively engage the support 46 to pivotably constrain the blade assembly 18. Specifically, when the L-bracket 86 of the lock mechanism 58 is in a locked state, as depicted in FIGS. 1 and 3, a projection 110 (FIG. 5) of the bracket 86 selectively interacts with the support 46, which corresponds to the first mode of operation. Conversely, when the L-bracket 86 is rotated out of the cavity, the L-bracket 86 is spaced away from the support 46, such that the L-bracket does not interact with the support 46. Specifically, a spring force biases the L-bracket 86 of the lock mechanism 58 towards an unlocked state in accordance with the second mode of operation, as shown in FIGS. 2 and 16.

Figure 14:
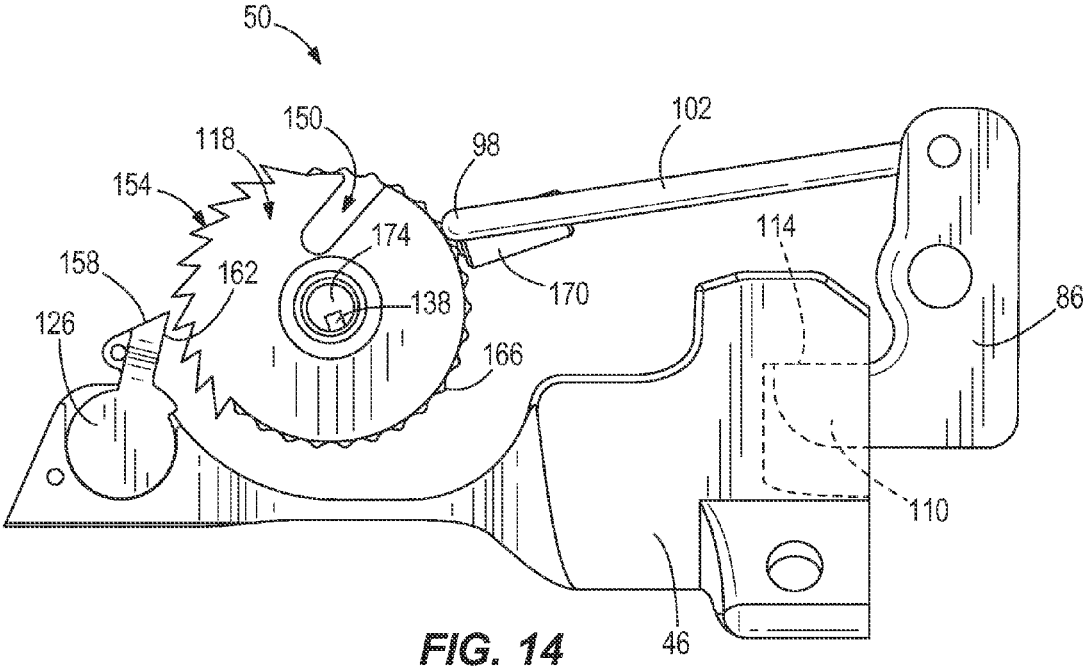
FIG. 14 is yet another side view of the mechanical mechanism.
Figure 15:
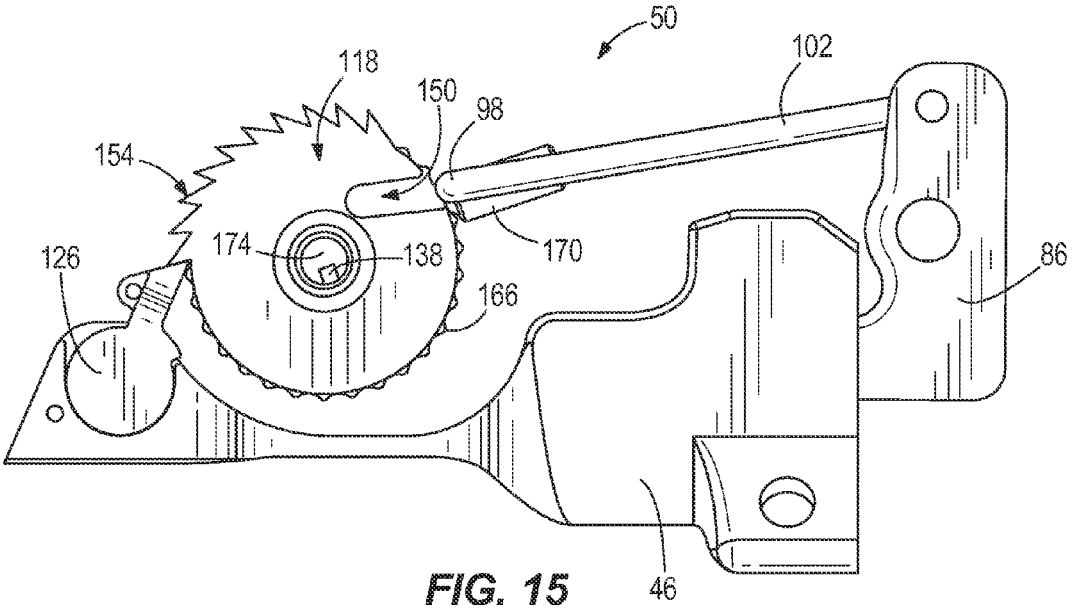
FIG. 15 is yet another side view of the mechanical mechanism.

With reference to FIGS. 3 and 5, the projection 110 of the L-bracket 86 is capable of selectively engaging with an inner ceiling 114 (FIG. 14) of the support 46 to pivotably constrain the rotation of the blade assembly 18 relative to the bridge member 14 in the locked state. Shown in FIG. 3, a distance D is provided between the projection 110 and the inner ceiling 114 when the support 46 abuts the rear mount 30 (i.e., the home position). The distance D gradually decreases when the blade assembly 18 pivots away for the bridge member 14 during a plantar flexion movement relative to the ground. Eventually, the projection 110 may abut the inner ceiling 114 resulting in the distance D substantially reducing to zero (FIG. 14). In the illustrated embodiment, the distance D is relatively small (e.g., less than 60 millimeters). This relatively small distance D ensures that the blade assembly 18 is limited to pivot in direction 42 within an acute angle (e.g., less than 30 degrees). Thus, the blade assembly 18 of the hybrid skate 10 is allowed to pivot relative to the bridge member 14 within a first angle range during the first mode of operation (e.g., a fixed ice-skate, etc.). Conversely, in the second mode of operation (FIG. 2), the projection 110 is spaced away from the support 46 prohibiting interaction between the projection 110 and the inner ceiling 114. Thus, the blade assembly 18 is permitted to pivot relative to the bridge member 14 within a second angle range that is greater than the first angle range.

Figure 6:
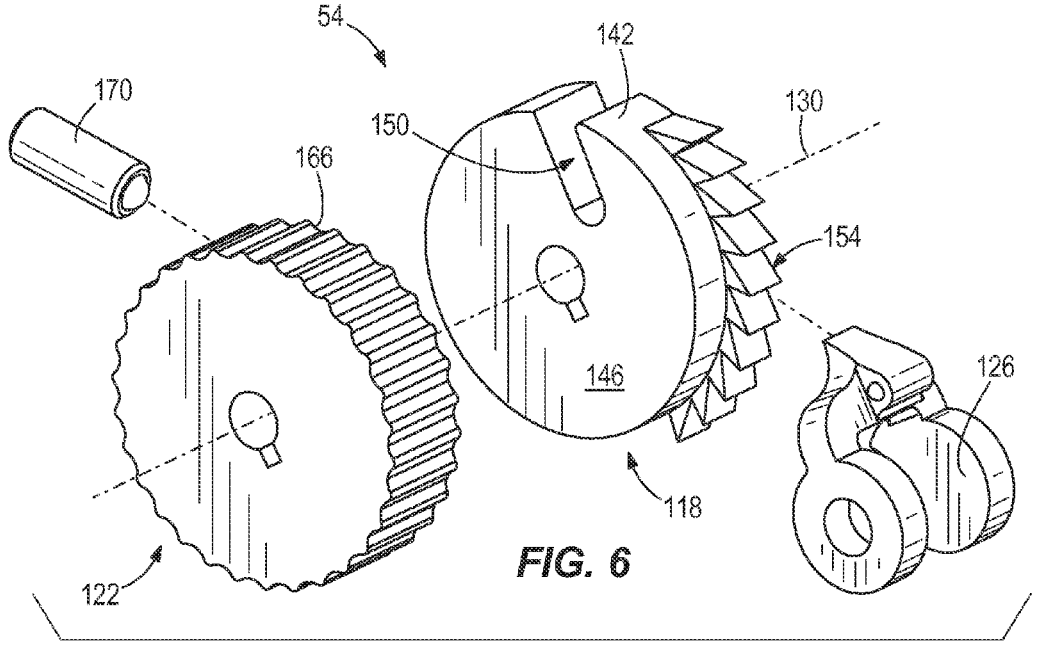
FIG. 6 is a perspective view of an index mechanism of the ice-skate.

With reference to FIGS. 3 and 4, the index mechanism 54 is at least partially disposed within and supported by the pocket 66 of the rear mount 30. As shown in FIG. 6, the index mechanism 54 includes a ratchet gear 118, a sprocket 122, and a pawl 126. The sprocket 122 and the ratchet gear 118 are coaxial with a rotational axis 130 that extends transversely through the pocket 66 (FIG. 4). A key 138 rotationally couples the sprocket 122 and the ratchet gear 118 together for co-rotation about the rotational axis 130. Although not show in the illustrated embodiment, the ratchet gear 118 and the sprocket 122 can alternatively be a unibody structure.

Figure 7:
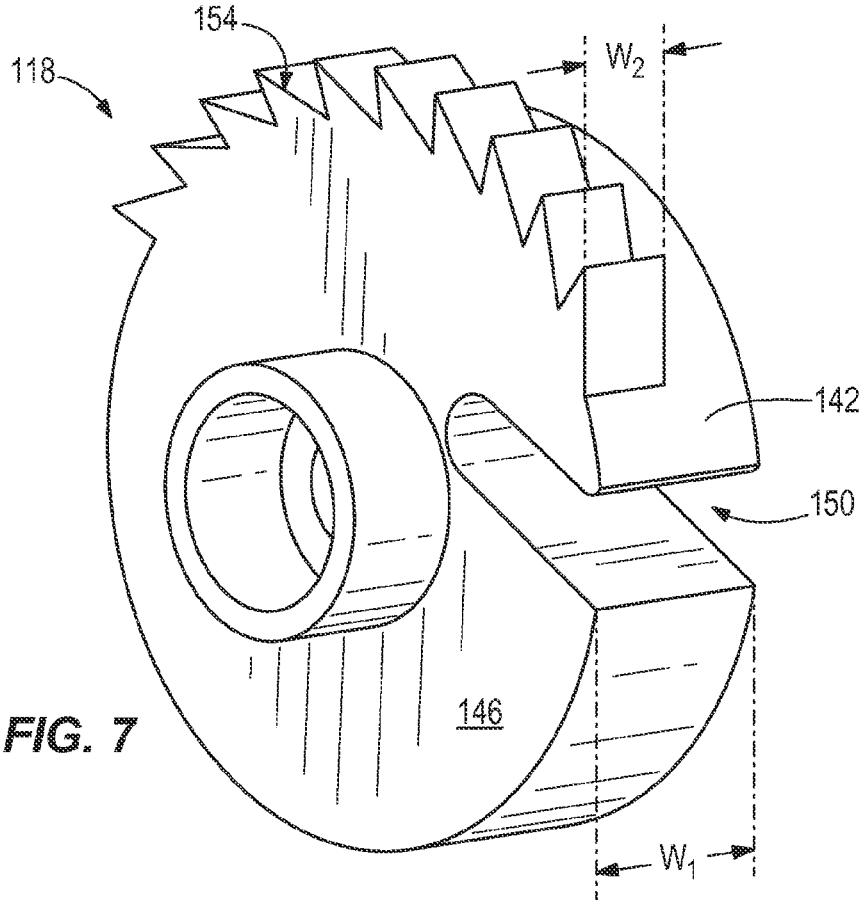
FIG. 7 is a perspective view of a ratchet gear of the index mechanism of FIG. 6.
Figure 8:
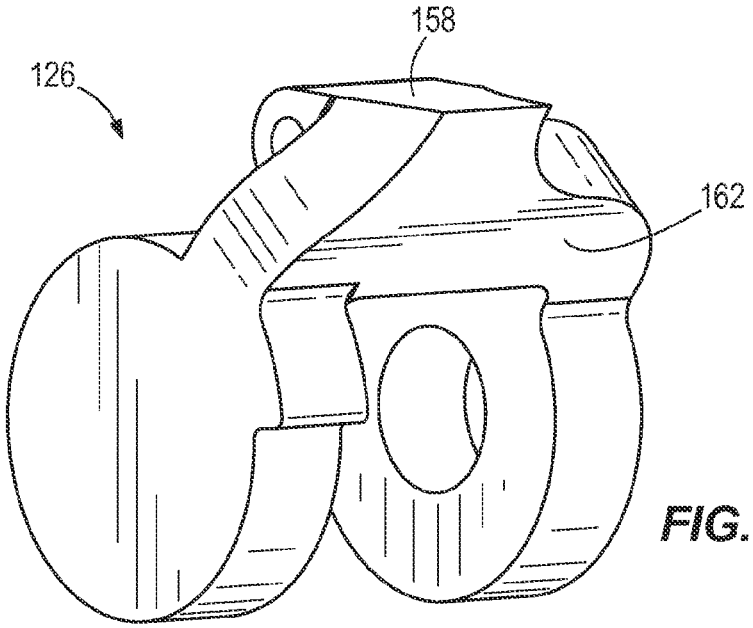
FIG. 8 is a perspective view of a pawl of the index mechanism of FIG. 6.

With reference to FIGS. 6 and 7, the ratchet gear 118 includes a partially smooth circumference 142, and a pair of opposed surfaces 146 defining a width $W_1$ of the ratchet gear 118 (FIG. 7). Disposed on the circumference 142 of the ratchet gear 118 is an inwardly extending recess 150, and a plurality of teeth 154 angularly offset from the recess 150. The recess 150 is correspondingly sized and shaped to accommodate the distal end 98 of the piston 90 (FIG. 16). The plurality of teeth 154 have a width $W_2$ that is less than the width $W_1$ allowing the smooth circumference 142 to extend on at least one side of the plurality of teeth 154. The pawl 126, which is pivotably coupled to the support 46, includes a first engagement surface 158 and a second engagement surface 162 that is adjacent to the first engagement surface 158 (FIG. 8). The pawl 126 is spring biased towards the ratchet gear 118, and interacts directly with the plurality of teeth 154 to facilitate ratcheting the index mechanism 54 throughout the predetermined interval (FIGS. 10-14). Although not shown in the illustrated embodiment of the plurality of teeth 154, the number of teeth disposed on the circumference 142 of the ratchet gear 118 may vary to prolong or shorten the amount of ratcheting throughout the interval.

Figure 12:
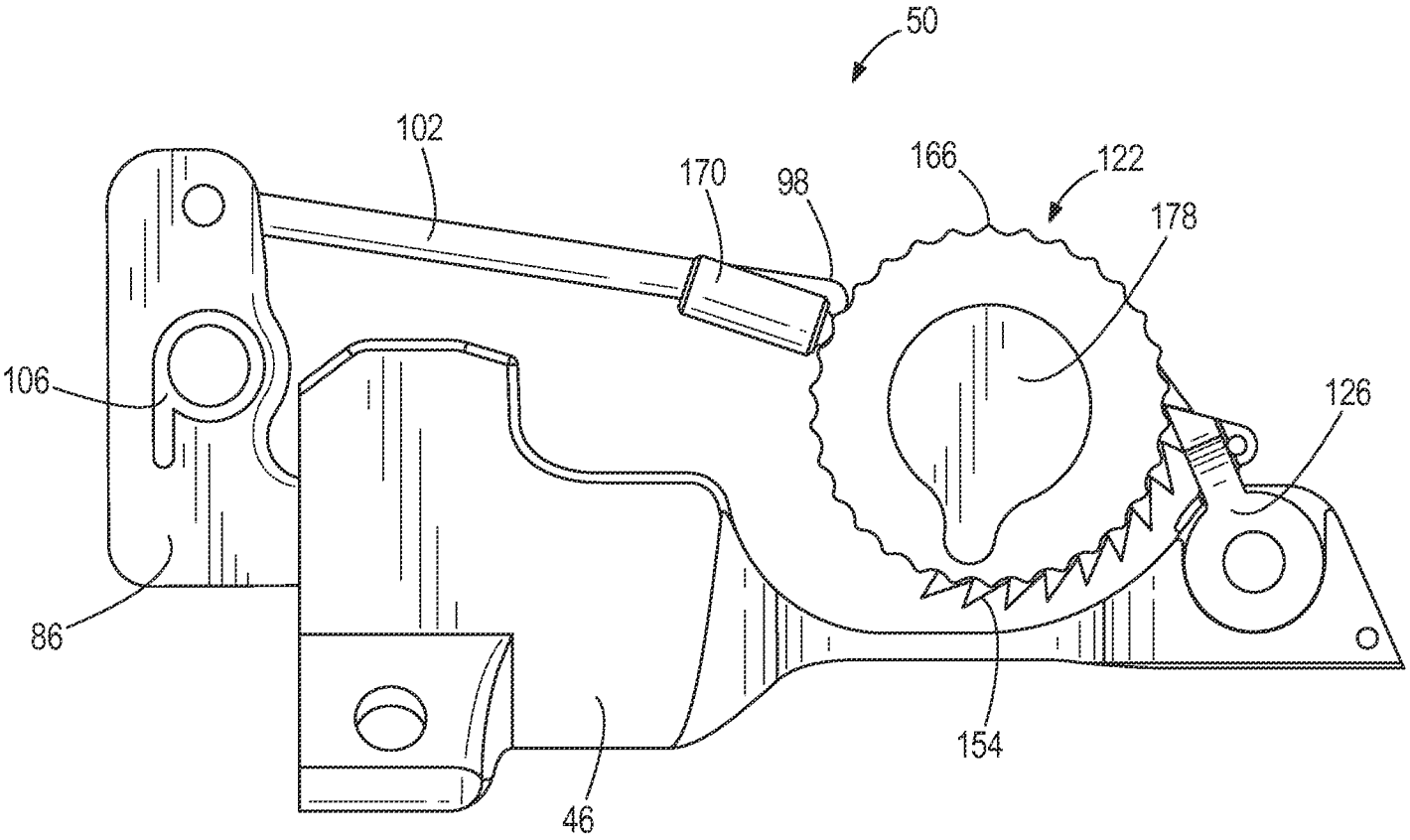
FIG. 12 is a side view of the mechanical mechanism of the ice-skate.

With reference to FIG. 6, the sprocket 122 has a series of ridges 166 disposed on the circumference. A spring-loaded plunger 170 is configured to be positioned in an aperture (not shown) within the pocket 66 of the bridge member 14 to interface with the ridges 166 of the sprocket 122. As shown in FIG. 12, the plunger 170 sits between adjacent ridges 166 to prohibit unrestricted angular displacement of the sprocket 122. However, when a sufficient rotational force is applied to at least the sprocket 122 or the ratchet gear 118, the ridges 166 are configured to bias against the plunger 170 as the sprocket 122 angularly displaces (FIG. 14).

Figure 9:
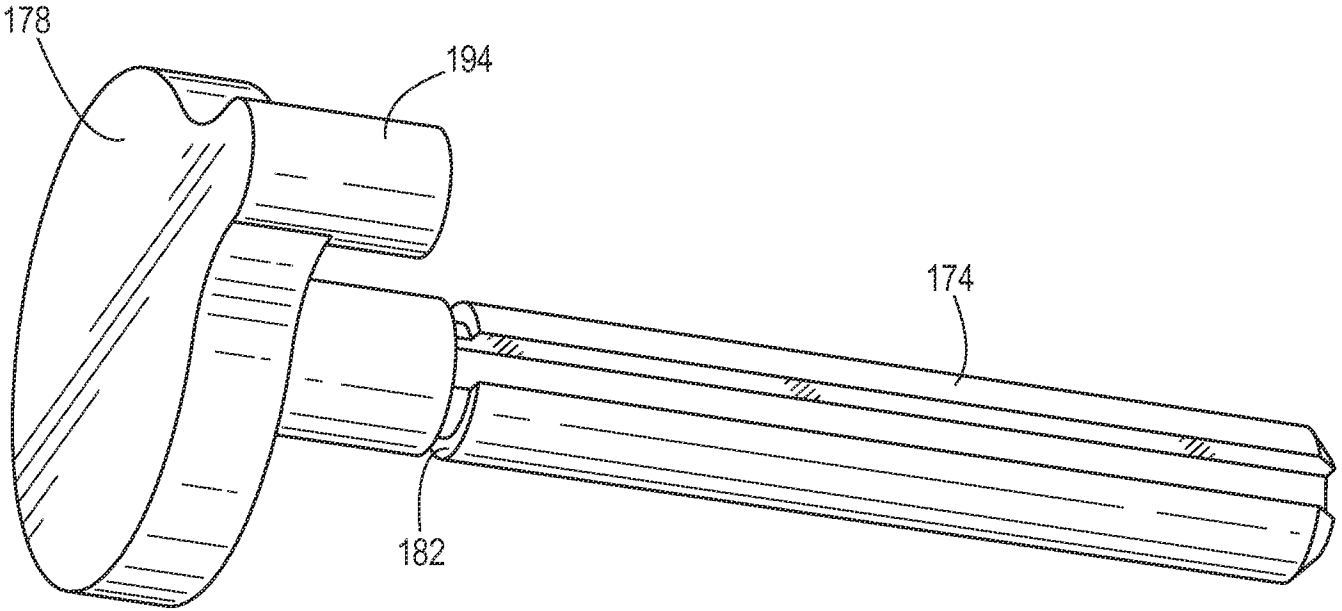
FIG. 9 is a component of a userability mechanism of the ice-skate.
Figure 10:
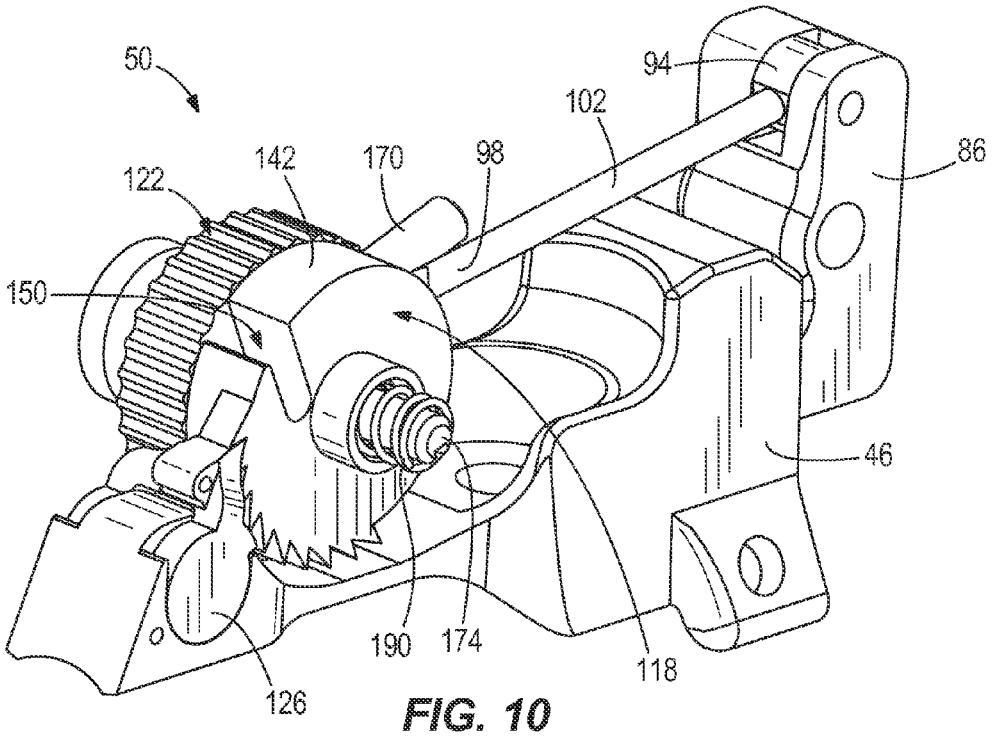
FIG. 10 is a perspective view of a mechanical mechanism of the ice-skate.
Figure 11:
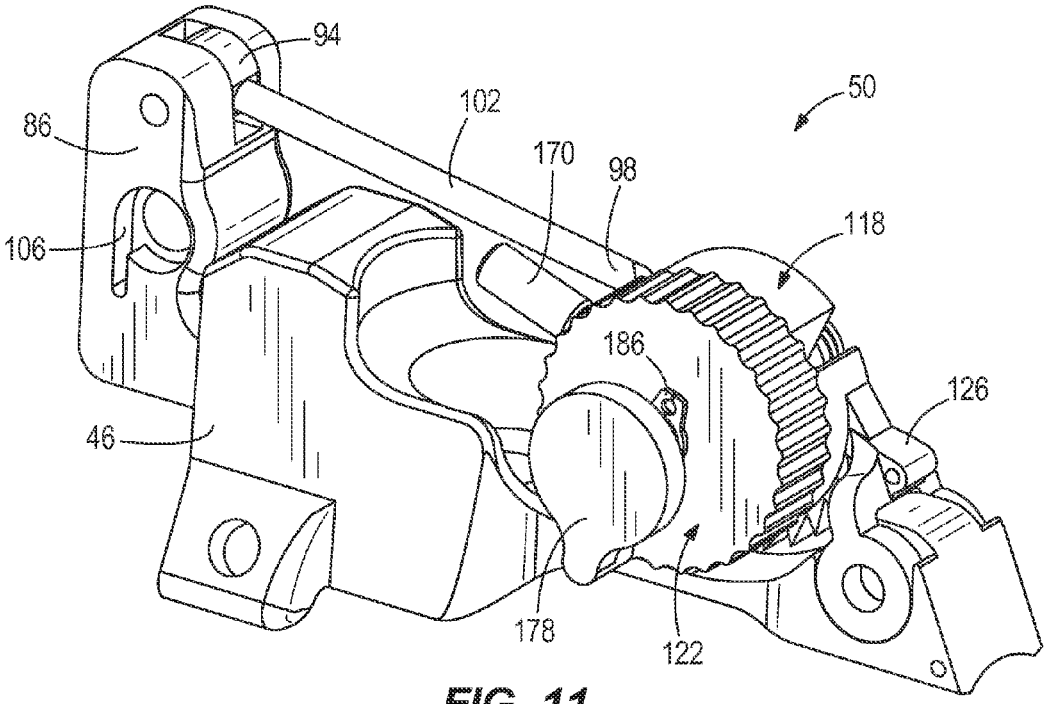
FIG. 11 is another perspective view of the mechanical mechanism of the ice-skate.

With reference to FIGS. 4 and 9, the userability mechanism 62, as previously described, is configured to facilitate at least one of the setting and the adjusting of the predetermined interval of which the index mechanism 54 ratchets through. The userability mechanism 62 includes a keyed shaft 174, and a button 178 coupled to the keyed shaft 174 (FIG. 9). The key 138 of FIG. 4 sits in the keyed shaft 174 to facilitate co-rotation of the keyed shaft 174, the sprocket 122, and the ratchet gear 118. The keyed shaft 174 further includes a radial slot 182 that extends inwardly around the circumference of the keyed shaft 174 proximate the button 178. The radial slot 182 is configured to receive a retaining ring 186 (FIG. 4), such that any displacement of the keyed shaft 172 in the axial direction is correspondingly transferred to at least one of the sprocket 122 and the ratchet gear 118.

Figure 17:
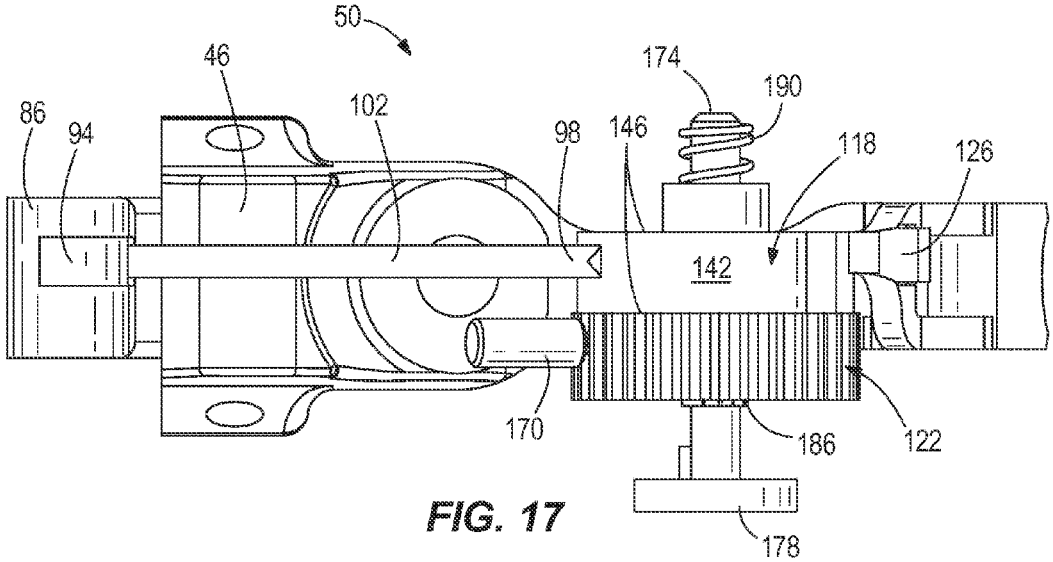
FIG. 17 is a top view of the mechanical mechanism.
Figure 18:
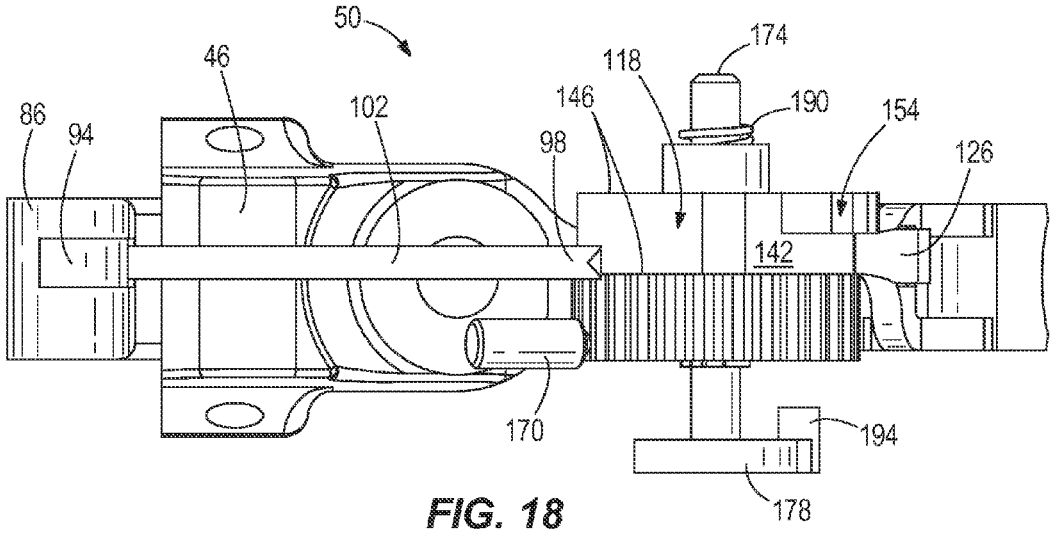
FIG. 18 is another top view of the mechanical mechanism.

For example, FIGS. 17 and 18 illustrate the button 178 being displaced along an axis of the keyed shaft 178 coaxial with axis 130 resulting in the retaining ring 186 transferring the corresponding displacement to the ratchet gear 118 and the sprocket 122. This displacement of the button 178 is caused from an operator urging against the bias of a spring 190. The spring 190 maintains the interaction between the plurality of teeth 154 of the index mechanism 54 and the pawl 126 (FIG. 17). However, upon the operator actuating the userability mechanism 62, the smooth circumference 142 of the index mechanism 54 interacts with the pawl 126, rather than the plurality of teeth 154 (FIG. 18). The button 178 can be rotated in either a clockwise or counterclockwise direction to at least one of set and adjust the index mechanism 54 when the pawl 126 interacts with the smooth circumference 142. The button 178 includes a stop arm 194 (FIG. 9) configured to interact with the rear mount 30 to limit rotation of the button 178. The index mechanism 54 is fully reset when the arm 194 abuts the rear mount 30 (FIG. 1).

In operation, the illustrated embodiment of the hybrid skate 10 is configurable in the first mode of operation mode (e.g., a fixed ice-skate, etc.). In the first mode of operation, the blade assembly 18 is pivotably constrained relative to the bridge member 14 within a first angle range. The hybrid skate 10 is also configurable in the second mode of operation (e.g., a clap ice-skate, etc.). In the second mode of operation, the blade assembly 18 is pivotable relative to the bridge member 14 within a second angle range that is greater than the first angle range.

Figure 19:
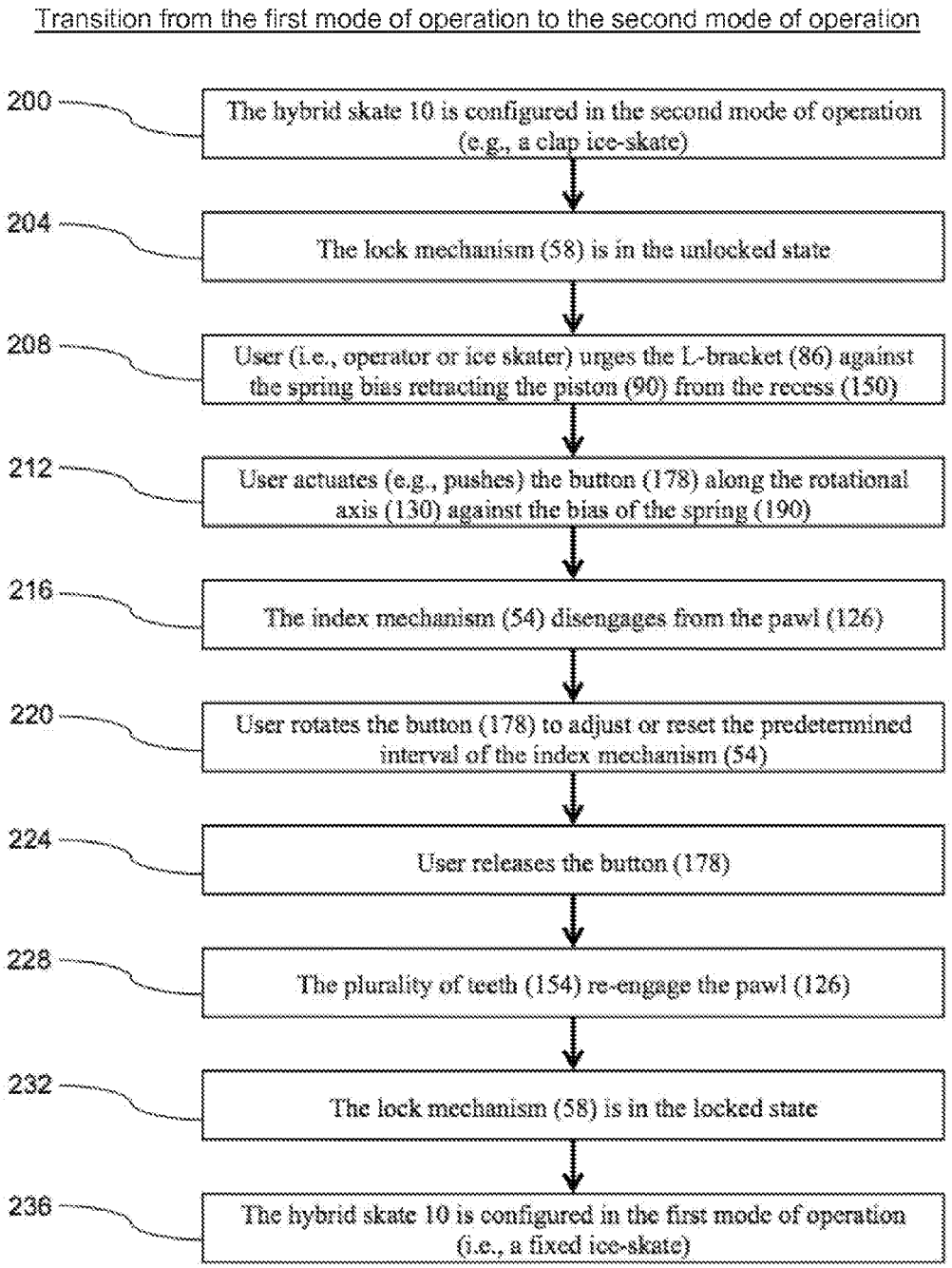
FIG. 19 is a flow chart of the transition from a first mode of operation to a second mode of operation of the ice-skate.

With reference to FIG. 19, to configure the hybrid skate 10, for example, from the second mode of operation to the first mode of operation, the operator performs a series of steps, such as steps 200-236. In general, to configure the hybrid skate 10 in the first mode of operation, the operator positions the lock mechanism 58 in the locked state. More specifically, when the lock mechanism 58 is in the unlocked state (step 204), the operator urges the L-bracket 86 against the spring bias. As a result, the distal end 98 of the piston 90 retracts from the recess 150 of the ratchet gear 118 (step 208). Subsequently, to set or adjust the predetermined interval of the index mechanism 58, the operator actuates (e.g., pushes, etc.) the button 178 (step 212). Actuating the button 178 causes the plurality of teeth 154 to disengage from the pawl 126 (step 216) thereby allowing the operator to rotate the button 178 (step 220). Accordingly, the operator can turn the userability mechanism 62 in a clockwise direction until the stop arm 194 of the button 178 abuts the rear mount 30 to fully reset the index mechanism 54, as shown in FIGS. 1 and 12. Once the operator sets the index mechanism 54 in the desired position, the operator releases the button 178, such that the plurality of teeth 154 re-engage the pawl 126 (steps 224-228). Consequently, the lock mechanism 58 is in the locked state (step 232) and the hybrid skate 10 in configured in the first mode of operation step 236) (e.g., a fixed ice-skate, etc.).

Figure 20:
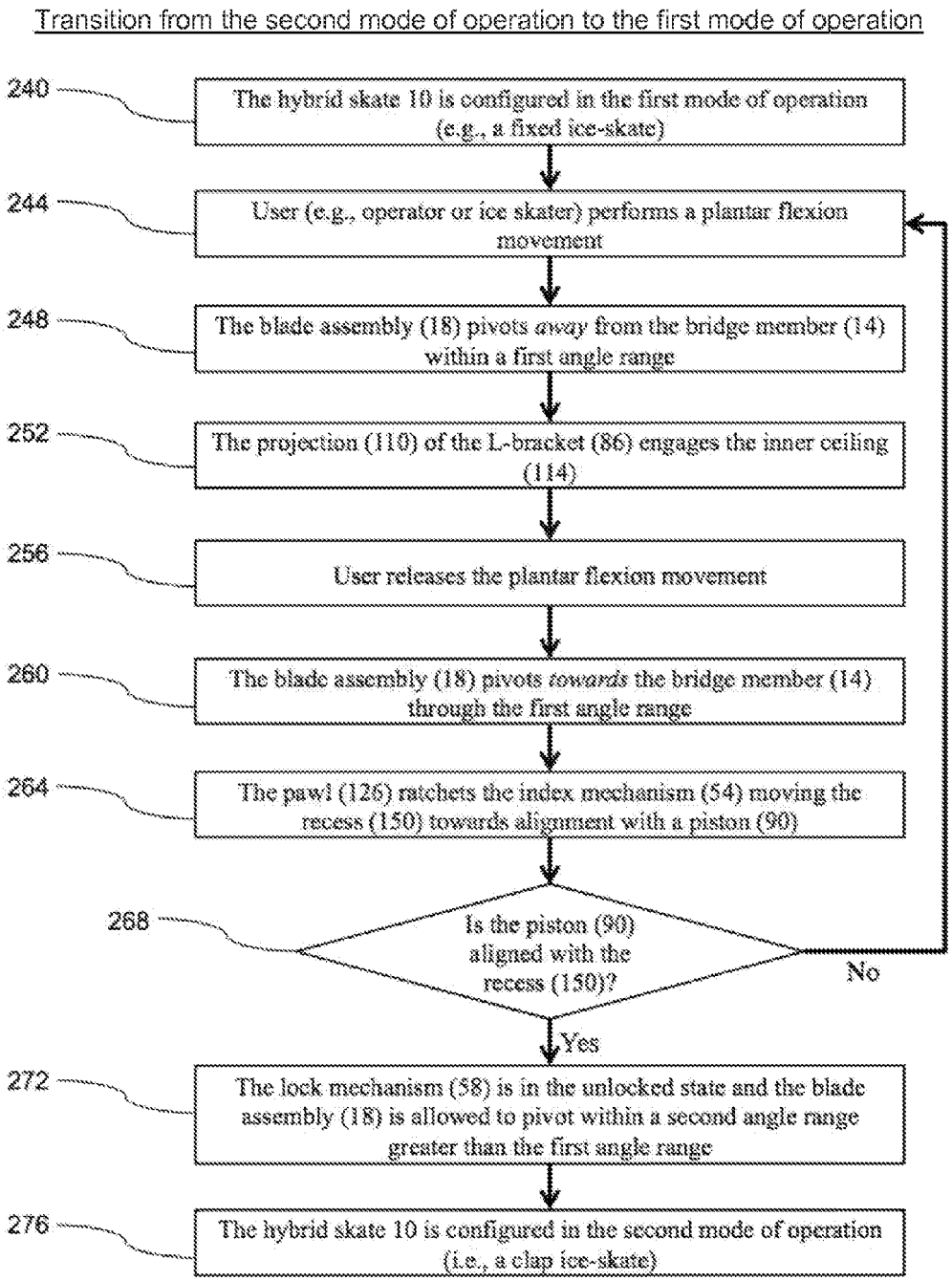
FIG. 20 is a flow chart of the transition from the second mode of operation to the first mode of operation of the ice-skate.

With reference to FIG. 20, to configure the hybrid skate 10, for example, from the first mode of operation to the second mode of operation, the operator performs a series of steps, such as steps 240-276. In general, the mechanical mechanism 50 automatically operates (e.g., advances, indexes, counts, actuates, etc.) while the operator performs conventional skating technique. Specifically, the operator performs a plantar flexion movement relative to the ground as a natural part of conventional skating technique (step 244). As a result, the blade assembly 18 pivots away from the bridge member 14 within the first angle range (step 248). The projection 110 of the L-bracket, in turn, engages the inner ceiling 114 (step 252). Again, as a natural part of conventional skating technique, the operator releases the plantar flexion movement relative to the ground (step 256). As a result, the blade assembly 18 pivots towards the bridge member 14 through the first angle range (step 260), and the pawl 126 ratchets the index mechanism 54 (e.g., by one tooth for each plantar flexion movement). As such, the recess 150 moves towards alignment with the piston 90 (step 264). Steps 244-264 repeat until the piston 90 aligns with the recess 150 (step 268), at which point the recess 150 receives the piston 90. Consequently, the lock mechanism 58 is in the unlocked state and the blade assembly 18 is allowed to pivot within the second angle range that is greater than the first angle range (step 272), such that the hybrid skate 10 is configured in the second mode of operation step 276) (e.g., a clap ice-skate, etc.).

What is claimed is:

1. A skate, comprising:

a bridge member;

a blade assembly pivotably coupled to the bridge member about a transverse axis;

wherein the blade assembly is operable between a first mode of operation during a predetermined interval and a second mode of operation after the predetermined interval, wherein the first mode of operation configures the blade assembly to pivot relative to the bridge member within a first angle range, wherein the second mode of operation configures the blade assembly to pivot relative to the bridge member within a second angle range greater than the first angle range, and wherein the skate automatically transitions from the first mode of operation to the second mode of operation.

2. The skate of claim 1, further comprising an index mechanism and a lock mechanism operable to facilitate the transition of the skate between the first mode of operation and the second mode of operation in response to a plantar flexion movement.

3. The skate of claim 2, wherein the lock mechanism is coupled at least partially to at least one of the bridge member and the blade assembly, the locking mechanism is operable in a locked state and an unlocked state.

4. The skate of claim 3, wherein the lock mechanism is in the locked state in the first mode of operation, and is in the unlocked state in the second mode of operation.

5. The skate of claim 3, wherein the lock mechanism further includes a first member and a second member, the first member configured to engage with the second member in the locked state, and wherein the first member is configured to disengage from the second member in the unlocked state.

6. The skate of claim 2, wherein the index mechanism facilitates the automatic transition between the first mode of operation and the second mode of operation.

7. The skate of claim 6, wherein the predetermined interval is defined by a number of skating strides, and wherein the index mechanism advances in response to each skating stride until the predefined number of skating strides is reached in the first mode of operation, at which point the skate automatically reconfigures into the second mode of operation.

8. The skate of claim 6, further comprising a reset mechanism configured to facilitate at least one of setting and adjusting the predetermined interval in which the index mechanism indexes through.

9. A mechanical mechanism for use with a skate, the mechanical mechanism comprising:

a lock mechanism configured to limit pivotal movement of a blade assembly of the skate relative to a bridge member of the skate within a first angle range; and an index mechanism configured to facilitate automatic unlocking of the lock mechanism in response to a predetermined interval being reached through conventional skating technique, wherein the blade assembly is allowed to pivot relative to the bridge assembly within a second angle range that is greater than the first angle range when the lock mechanism is unlocked.

10. The mechanical mechanism of claim 9, wherein the predetermined interval is defined by a number of skating strides taken during the conventional skating technique.

11. The mechanical mechanism of claim 9, wherein the lock mechanism includes a lock member that interferes with a portion of the blade assembly in a locked state to inhibit movement of the blade assembly, and wherein the lock member no longer interferes with the blade assembly in an unlocked state.

12. The mechanical mechanism of claim 9, further comprising a reset mechanism configured to facilitate at least one of setting and adjusting the predetermined interval.

13. The mechanical mechanism of claim 9, wherein the indexing mechanism includes a ratchet gear coupled to the bridge member and rotatable in response to plantar flexion movement through conventional skating technique.

14. The mechanical mechanism of claim 13, wherein the indexing mechanism further includes a pawl mounted to the blade assembly that interacts with the ratchet gear to rotate the ratchet gear in one direction while inhibiting the ratchet gear from rotating in an opposite direction.

15. The mechanical mechanism of claim 13, wherein the ratchet gear includes a recess that receives a portion of the lock mechanism when the predetermined interval is reached, resulting in unlocking the lock mechanism.

16. The mechanical mechanism of claim 9, wherein the lock mechanism is biased toward being unlocked.

17. A skate, comprising:

a bridge member;

a blade assembly pivotably coupled to the bridge member;

a mechanical mechanism coupled to the bridge member and operable to transform the skate between a first mode of operation and a second mode of operation, the mechanical mechanism including a first lock member pivotably coupled to the bridge member and a second lock member mounted to bridge member, the first lock member is moveable between a locked state, in which the first lock member engages the second lock member, and an unlocked state, in which the first lock member disengages the second lock member, an index mechanism coupled to the bridge member that moves the first lock member to the unlocked state in response to a predetermined interval being reached, wherein the first lock member is biased toward the unlocked state.

18. The skate of claim 17, wherein the index mechanism is a ratchet gear that is rotatable in response to plantar flexion movement through conventional skating technique.

* * * * *